US010815634B2

(12) United States Patent
O'Brien et al.

(10) Patent No.: US 10,815,634 B2
(45) Date of Patent: Oct. 27, 2020

(54) LOADER ATTACHMENTS COUPLER

(71) Applicant: DEERE & COMPANY, Moline, IL (US)

(72) Inventors: David O'Brien, Dubuque, IA (US); Arun Narayanan, Dubuque, IA (US); Jason Simmons, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 16/285,361

(22) Filed: Feb. 26, 2019

(65) Prior Publication Data

US 2020/0270839 A1 Aug. 27, 2020

(51) Int. Cl.

| | |
|---|---|
| ***E02F 3/36*** | (2006.01) |
| ***E02F 3/96*** | (2006.01) |
| ***E02F 3/34*** | (2006.01) |

(52) U.S. Cl.

CPC ..... *E02F 3/3631* (2013.01); *E02F 3/34* (2013.01); *E02F 3/96* (2013.01)

(58) Field of Classification Search

CPC ..... E02F 3/34; E02F 3/3661; E02F 3/96

See application file for complete search history.

(56) References Cited

U.S. PATENT DOCUMENTS

| | | | | | |
|---|---|---|---|---|---|
| 5,010,962 | A * | 4/1991 | Bloom, Jr. | E02F 3/3604 | 116/281 |
| 5,529,419 | A * | 6/1996 | Gebauer | B66F 9/12 | 172/273 |
| 5,865,594 | A * | 2/1999 | Kim | E02F 3/3411 | 414/723 |
| 2008/0141566 | A1* | 6/2008 | Esser | E02F 3/3631 | 37/468 |
| 2012/0237292 | A1* | 9/2012 | Seda | E02F 3/3631 | 403/376 |

* cited by examiner

*Primary Examiner* — Ronald P Jarrett
(74) *Attorney, Agent, or Firm* — Taft Stetinius & Hollister LLP; Stephen F. Rost

(57) ABSTRACT

A coupler for a work machine that has a first coupler hook pin defined along a hook pin axis, a first coupler engaging pin defined along a first axis, a second coupler engaging pin defined along a second axis, the second axis being different from the first axis. Wherein, the first coupler engaging pin is coupleable to a first device and the second coupler engaging pin is coupleable to a second device.

16 Claims, 12 Drawing Sheets

LOADER ATTACHMENTS COUPLER

FIELD OF THE DISCLOSURE

The present disclosure relates to a coupler for a loader and more specifically to a coupler for a loader that has a dual interface.

BACKGROUND

Loaders and the like frequently have a coupler that allows a work tool to be coupled to a boom assembly. The work tool and coupler have corresponding coupling points that allow the work tool to be coupled to the coupler when the coupling points are aligned. Current loader couplers have coupling points that correspond with only a single type of work tool coupler. Accordingly, current loader couplers are limited to being coupled to work tools with the single type of work tool for which the loader coupler corresponds.

SUMMARY

One embodiment is a coupler for a work machine that has a first coupler hook pin defined along a hook pin axis, a first coupler engaging pin defined along a first axis, a second coupler engaging pin defined along a second axis, the second axis being different from the first axis. Wherein, the first coupler engaging pin is coupleable to a first device and the second coupler engaging pin is coupleable to a second device.

One example has a second coupler hook pin axially offset along the hook pin axis relative to the first coupler hook pin. Wherein the first device is coupleable to the coupler at the first coupler hook pin and the first coupler engaging pin and the second device is coupleable to the coupler at the second coupler hook pin and the second coupler engaging pin.

Another example has a pin engagement cylinder that selectively transitions the first coupler engaging pin and the second coupler engaging pin between an engaged position and a disengaged position. In one aspect of this example, the pin engagement cylinder is positioned along a cylinder axis, the cylinder axis being spaced from the first axis. In another aspect of this example, the cylinder axis is coaxial with the second axis. In yet another aspect of this example, the pin engagement cylinder is spaced from the first axis at least partially away from the hook pin axis to partially define a visibility region through the coupler. In another aspect, the first axis is defined through the visibility region but the first coupler engaging pin does not substantially block the visibility region.

Another example has a pin engagement linkage coupling the first coupler engaging pin to the second coupler engaging pin. In one aspect of this example, the pin engagement linkage has a visual indicator. Another aspect of this example has a pin engagement cylinder coupled to the second coupler engaging pin to selectively slide the first and second coupler engaging pins between an engaged positioned and a disengaged position and a front cover defining an inner cavity and having a slot defined therethrough, wherein the pin engagement cylinder is at least partially positioned within the inner cavity of the front cover. Part of this aspect has a sliding cover positioned along the slot and configured to slide along the slot as the first and second coupler engaging pins move between the engaged and disengaged position. Wherein, when the first and second coupler engaging pins are in the engaged position, the sliding cover substantially covers the slot.

Another embodiment is a dual interface coupler for a work machine that has a first coupler hook pin defined along a hook pin axis, a first coupler engaging pin defined along a first axis, a second coupler engaging pin defined along a second axis, the second axis being different from the first axis, and a pin engagement linkage coupling the first coupler engaging pin to the second coupler engaging pin.

In one example of this embodiment the first engaging pin is slidable axially along the first axis and the second engaging pin is slidable axially along the second axis and the pin engagement linkage couples the first coupler engaging pin to the second coupler engaging pin such that axial movement of one of the first or second coupler engaging pin causes axial movement of the other of the first or second coupler engaging pin.

Another example of this embodiment has a second coupler hook pin axially offset along the hook pin axis relative to the first coupler hook pin, wherein the first device is coupleable to the coupler at the first coupler hook pin and the first coupler engaging pin along a first coupler region and the second device is coupleable to the coupler at the second coupler hook pin and the second coupler engaging pin along a second coupler region. In one aspect of this example, the first coupler region and the second coupler region are separated from one another by a an intermediate plate, the intermediate plate having a transverse bend between the first coupler engagement pin and the first coupler hook pin. In another aspect of this disclosure, the second coupler region has a boom width at a first portion and a hook width at a second portion, the transverse bend of the intermediate plate defining the transition from the boom width to the hook width.

Another embodiment is a work machine that has a ground engaging mechanism coupled to a chassis, a prime mover configured to selectively power the ground engaging mechanism to move the work machine along an underlying surface, a boom assembly pivotally coupled to the chassis, and a dual interface coupler coupled to the boom assembly, the dual interface coupler having a first coupler hook pin set defined along a hook pin axis, a second coupler hook pin set defined along the hook pin axis, a first coupler engaging pin set defined along a first axis, a second coupler engaging pin set defined along a second axis, the second axis being different from the first axis. Wherein, the first coupler hook set and the first coupler engaging pin set are coupleable to a first device and the second coupler hook pin set and the second coupler engaging pin set are coupleable to a second device.

One example of this embodiment has a pin engagement cylinder that selectively transitions the first coupler engaging pin set and the second coupler engaging pin set between an engaged position and a disengaged position, the engagement cylinder having a single housing and two pistons acting in opposite directions of one another. One aspect of this embodiment has a linkage set coupling the first coupler engaging pin set and the second coupler engaging pin set to one another, the linkage set having an indicator thereon. Another aspect of this example has a front cover having an inner portion that at least partially covers the pin engagement cylinder, the front cover providing slots for the linkage set to extend from the inner portion to the first engaging pin set.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

Figure 1:
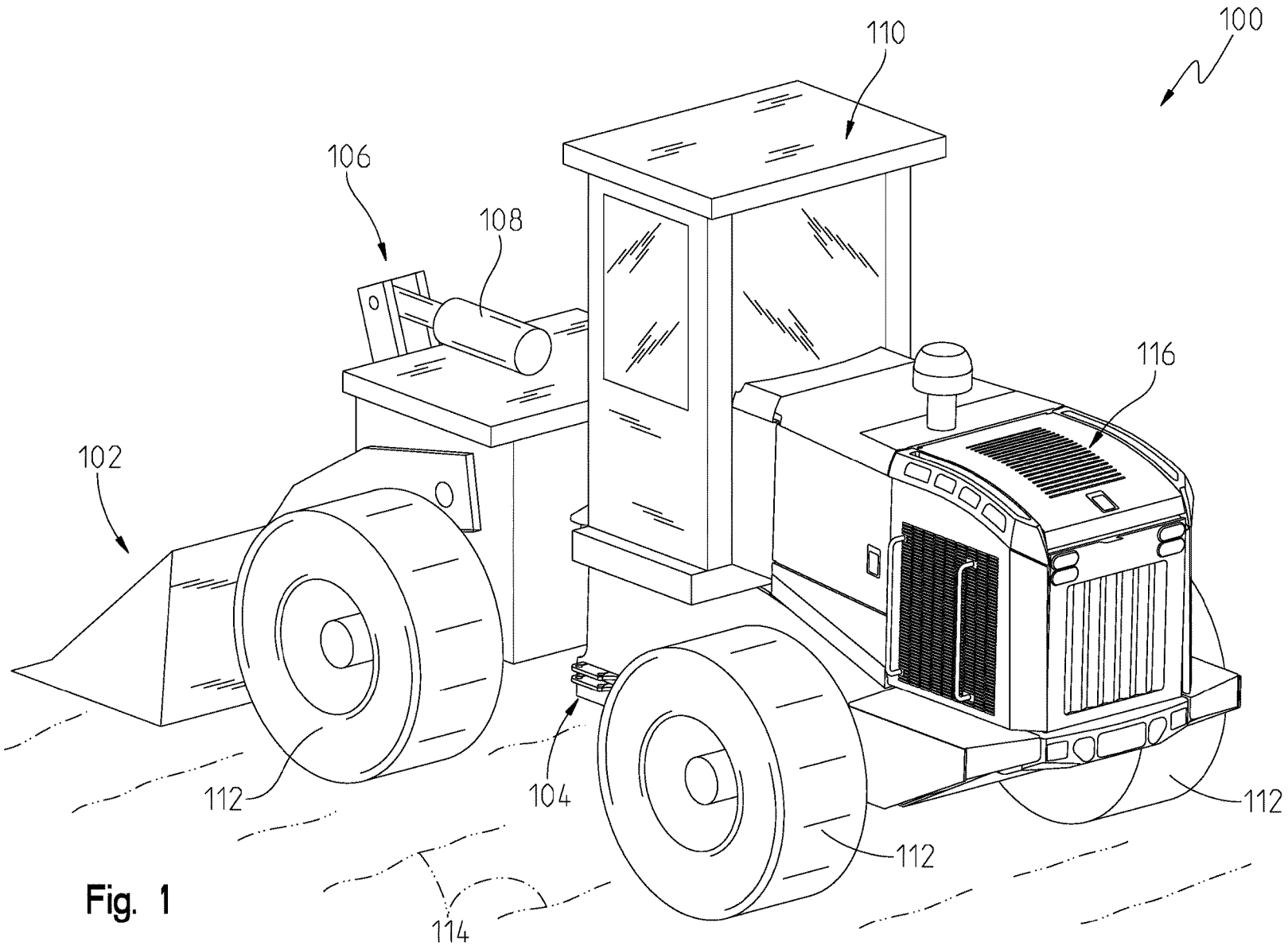
FIG. 1 is an elevated perspective view of a work machine.

For the purposes of promoting an understanding of the principles of the present disclosure, reference will now be made to the embodiments described herein and illustrated in the drawings and specific language will be used to describe the same. It will nevertheless be understood that no limitation of the scope of the present disclosure is thereby intended, such alterations and further modifications in the illustrated devices and methods, and such further applications of the principles of the present disclosure as illustrated therein being contemplated as would normally occur to one skilled in the art to which the present disclosure relates.

Referring to FIG. 1, one non-exclusive example of a work machine 100 that may implement the teachings of this disclosure is illustrated. The work machine 100 may be a front loader or the like and have a work tool 102 at a front end. The work tool 102 may be a bucket for manipulating debris, a fork assembly for managing cargo, or any other work tool known in the art to be used by the work machine 100.

The work tool 102 may be coupled to a chassis 104 of the work machine 100 through a boom assembly 106. The boom assembly 106 may have one or more linkages that pivotally couple the work tool 102 to the chassis 104 or other portion of the work machine 100. The boom assembly 106 may also include one or more linear actuator 108 that selectively manipulates the location of the work tool 102 relative to the chassis 104 via the pivotal coupling of the linkages thereto. In one non-exclusive example, the linear actuator 108 may be a hydraulic actuator that is selectively provided hydraulic fluid through user commands from a user interface in a cabin 110 of the work machine 100. While a hydraulic linear actuator 108 is described herein, the linear actuator 108 may also be an electric, pneumatic, or the like actuator. Further still, this disclosure contemplates utilizing any known method for moving the work tool 102 and is not limited to using linear actuators.

The work machine 100 may also have one or more ground engaging mechanism 112 rotationally coupled to the chassis 104. The ground engaging mechanism 112 may be a wheel, a track assembly, or any other assembly that can react with an underlying surface 114 or the surrounding environment to provide movement to the work machine 100. In one aspect of this disclosure, a prime mover 116 may be coupled to at least one ground engaging mechanism 112 to selectively move the work machine 100 along the underlying surface 114 based on user commands from the cabin 110 or elsewhere. The prime mover 116 may be a gas, diesel, or turbine engine among other things. Further, the prime mover 116 may be or have an electrical system that stores electrical energy that is utilized to engage the ground engaging mechanism 112 through an electric motor or the like. Accordingly, this disclosure contemplates utilizing any known prime mover 116 and ground engaging mechanism 112.

Figure 2:
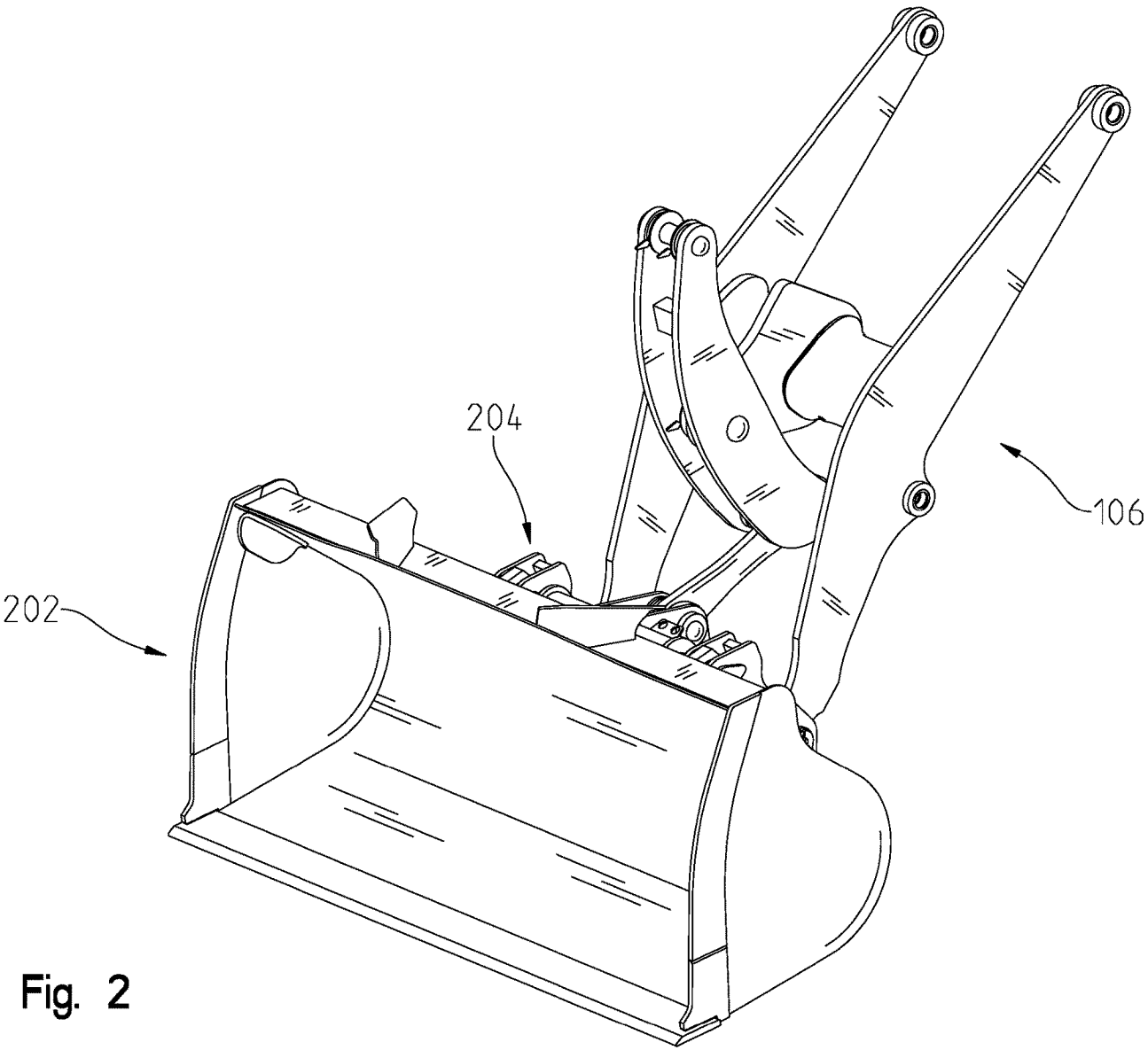
FIG. 2 is an elevated perspective view of a boom assembly coupled to a bucket.

Referring now to FIG. 2, one non-exclusive example of the present disclosure is illustrated with the boom assembly 106 removed from the work machine 100. In FIG. 2, a bucket 202 may be coupled to the boom assembly 106 through a dual interface coupler 204. In the embodiment of FIG. 2, the bucket 202 may be selectively coupled to the coupler 204 to be selectively repositioned via the boom assembly 106 to execute a work function.

Figure 3:
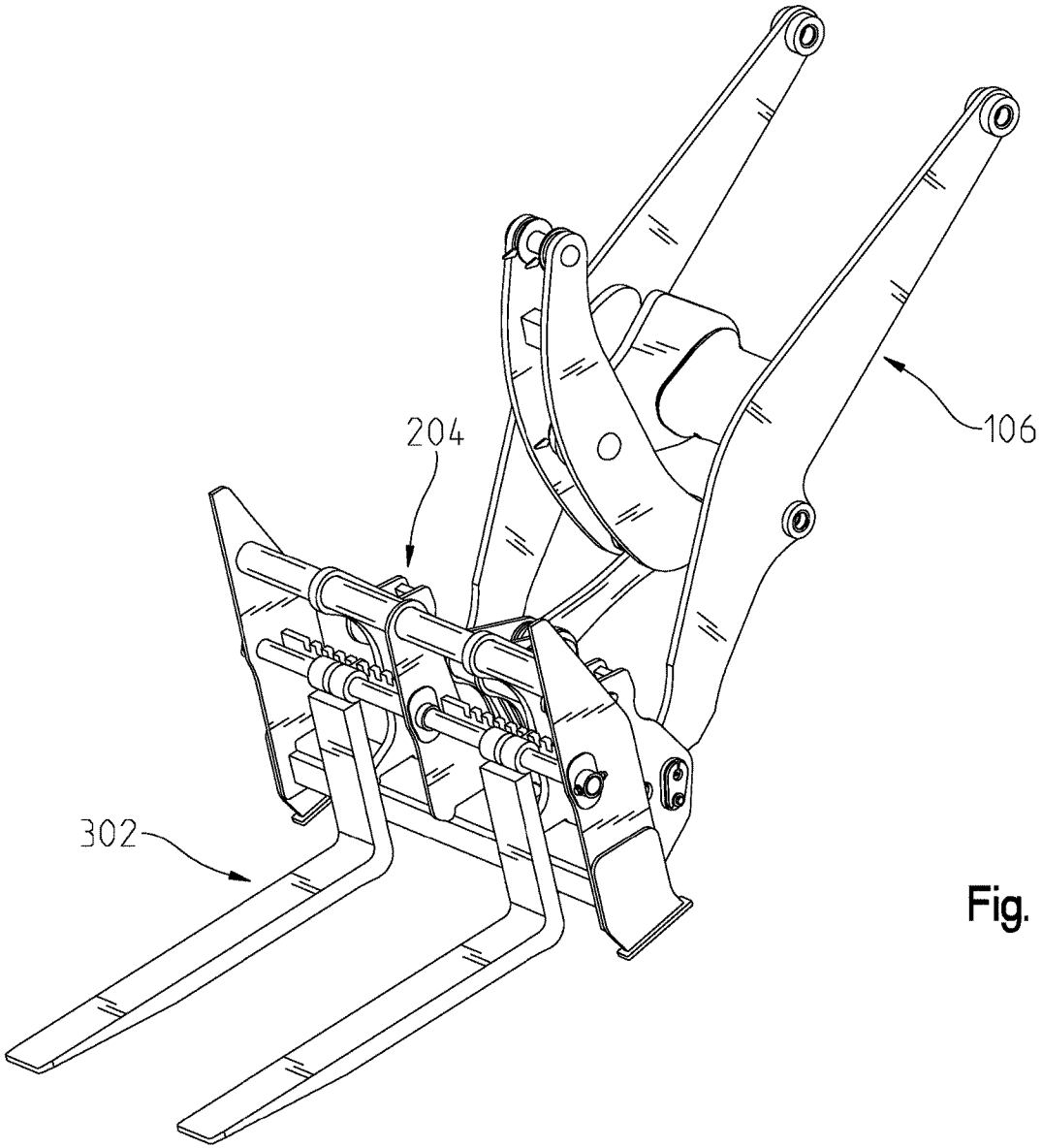
FIG. 3 is an elevated perspective view of a boom assembly coupled to a fork assembly.

Similarly in FIG. 3, another non-exclusive example of the present disclosure is illustrated with the boom assembly 106 removed from the work machine 100. In FIG. 3, a fork assembly 302 may be coupled to the boom assembly 106 through the coupler 204. In the embodiment of FIG. 3, the fork assembly 302 may be selectively coupled to the coupler 204 to be selectively repositioned via the boom assembly 106 to execute a work function.

Figure 4:
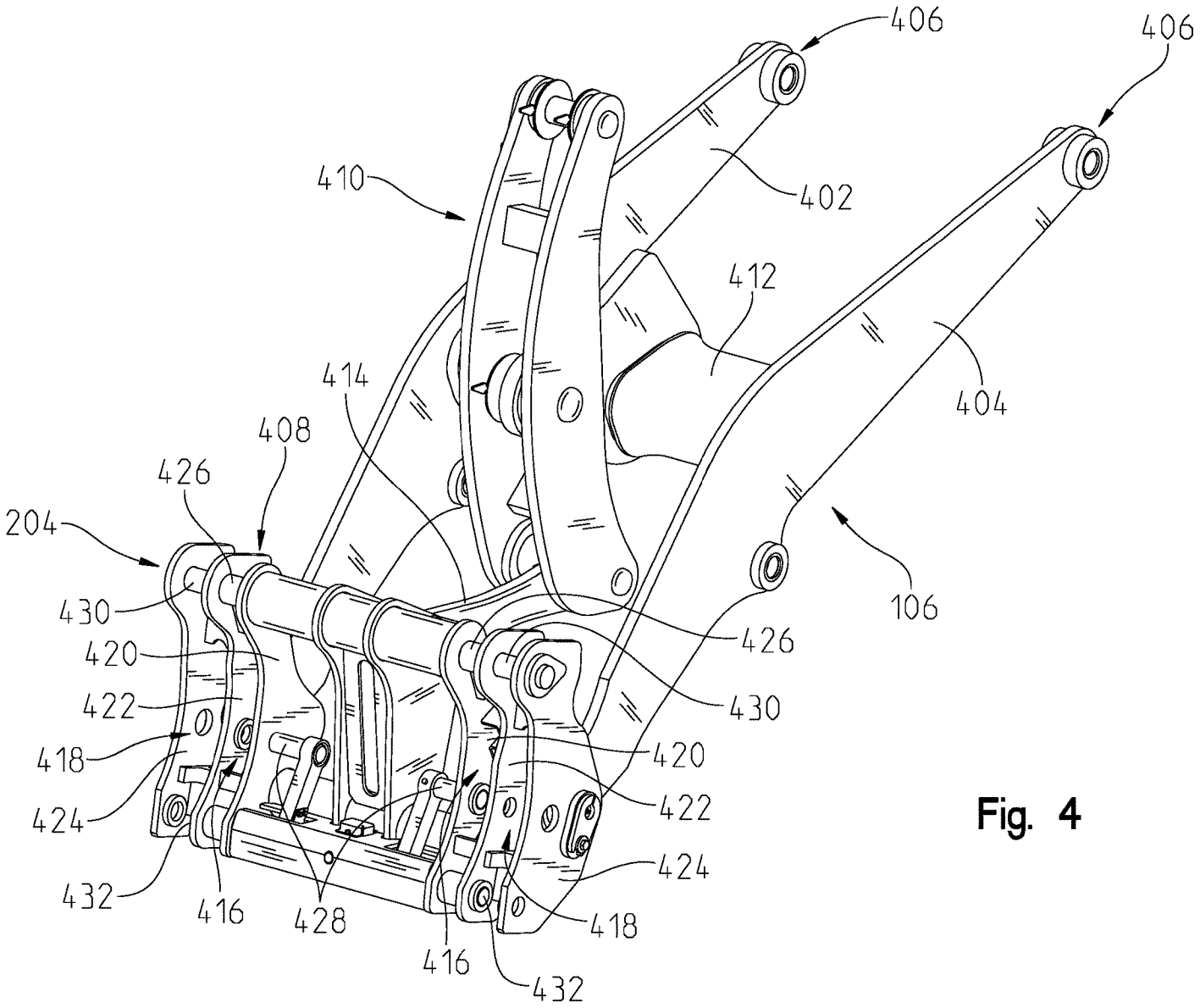
FIG. 4 is an elevated perspective view of a dual interface coupler coupled to a boom assembly.

Referring now to FIG. 4, the boom assembly 106 and coupler 204 are illustrated isolated from the work machine 100 and work tool 102. The boom assembly 106 may have a first and second boom arm 402, 404 pivotally coupled to the work machine 100 at a work machine end 406 and pivotally coupled to the coupler 204 at a coupler end 408. Further, the boom assembly 106 may have an orientation linkage 410 pivotally coupled to the boom arms 402, 404 at a cross member 412. The orientation linkage 410 may further have a connecting arm 414 pivotally coupled to the orientation linkage 410 on one end and to the coupler 204 on the other. One or more actuator may be coupled to the boom arms 402, 404 and the orientation linkage 410 to selectively reposition the coupler 204 relative to the work machine 100.

Figure 6A:
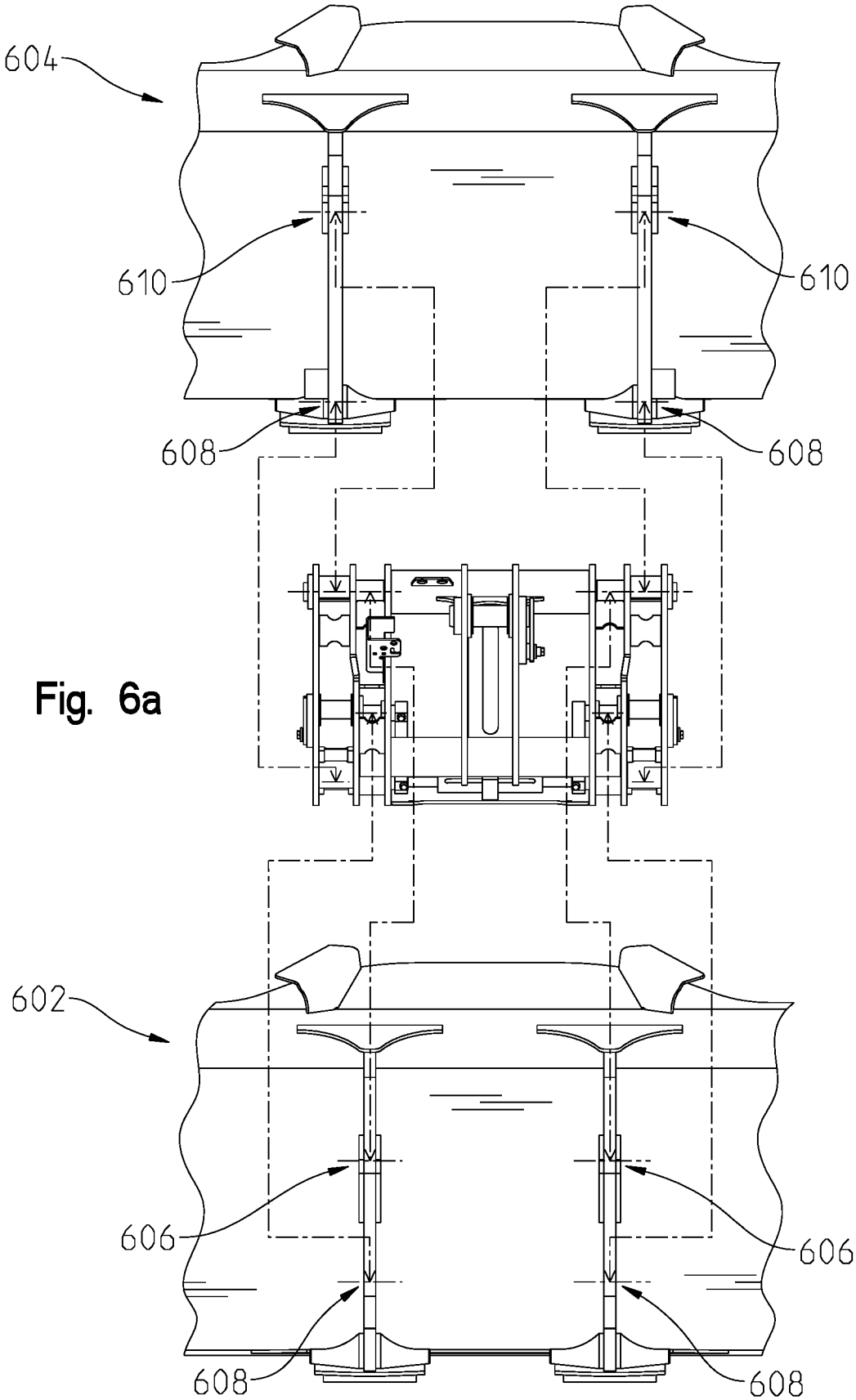
FIG. 6*a* is an illustrative view of coupling points for a first device and a second device.

In one aspect of this disclosure, the coupler 204 may have a first coupler region 416 and a second coupler region 418. The first coupler region 416 may be defined between inner plates 420 and intermediate plates 422 of the coupler 204. The second coupler region 418 may be defined between the intermediate plates 422 and end plates 424. The first coupler region 416 may be sized to correspond with a first work tool 602 (see FIG. 6*a*) and the second coupler region 418 may be sized to correspond with a second work tool 604 (see FIG. 6*a*). A first coupler hook pin set 426 and a first coupler engaging pin set 428 may selectively couple the first work tool 602 to the coupler 204. Similarly, a second coupler hook pin set 430 and a second coupler engaging pin set 432 may selectively couple the second work tool 604 to the coupler 204 as will be described in more detail herein.

The coupler 204 may have two sides that are substantially mirrored configurations of one another. Accordingly, with reference to the coupler 204, this disclosure will describe one side of the coupler 204. However, the description of one side of the coupler 204 will be applicable to the components of the opposing side as is apparent to a person having skill in the art of this disclosure in viewing the figures and description presented herein.

Figure 5:
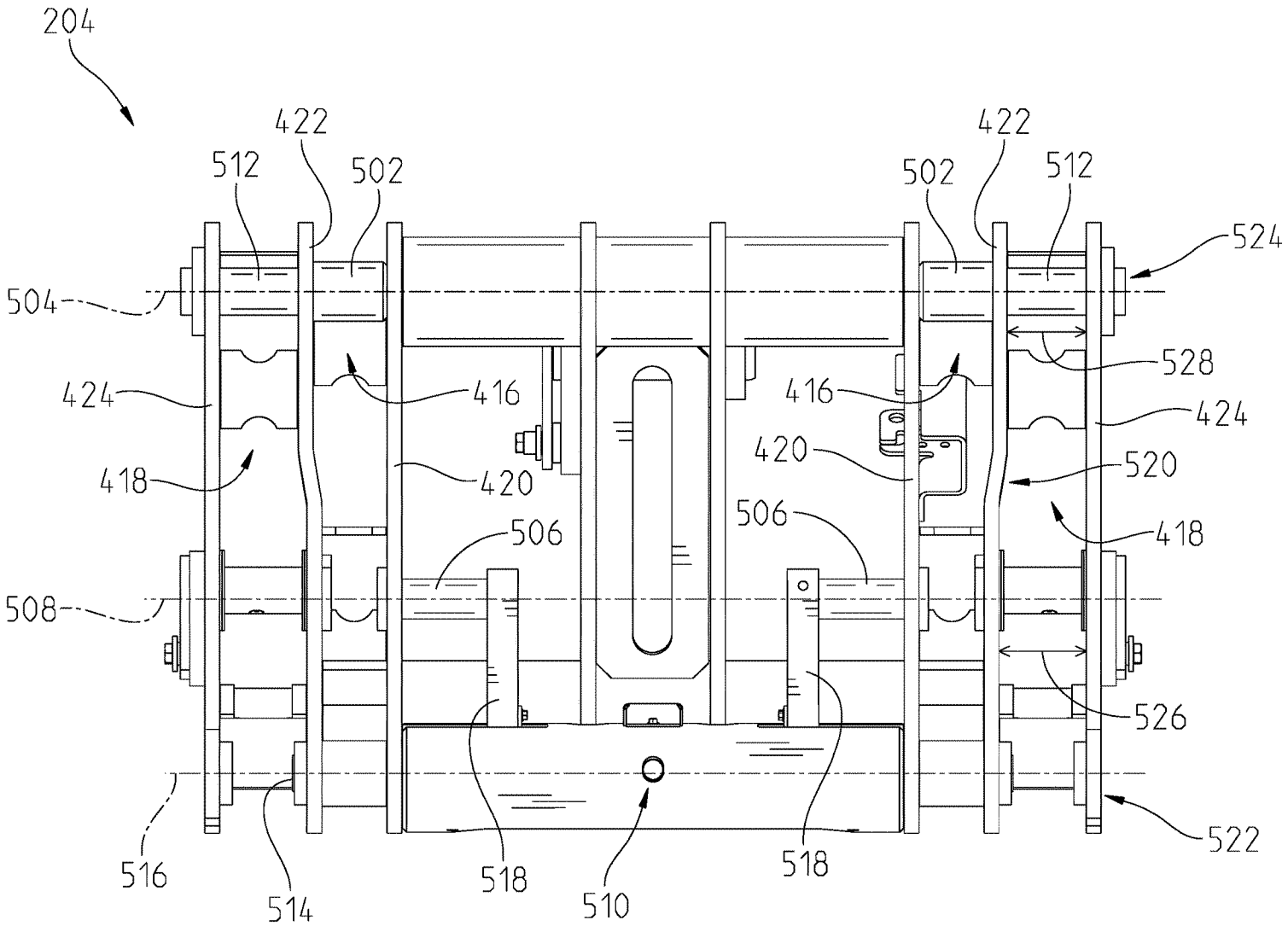
FIG. 5 is a front view of the dual interface coupler of FIG. 4 in a disengaged position.
Figure 6B:
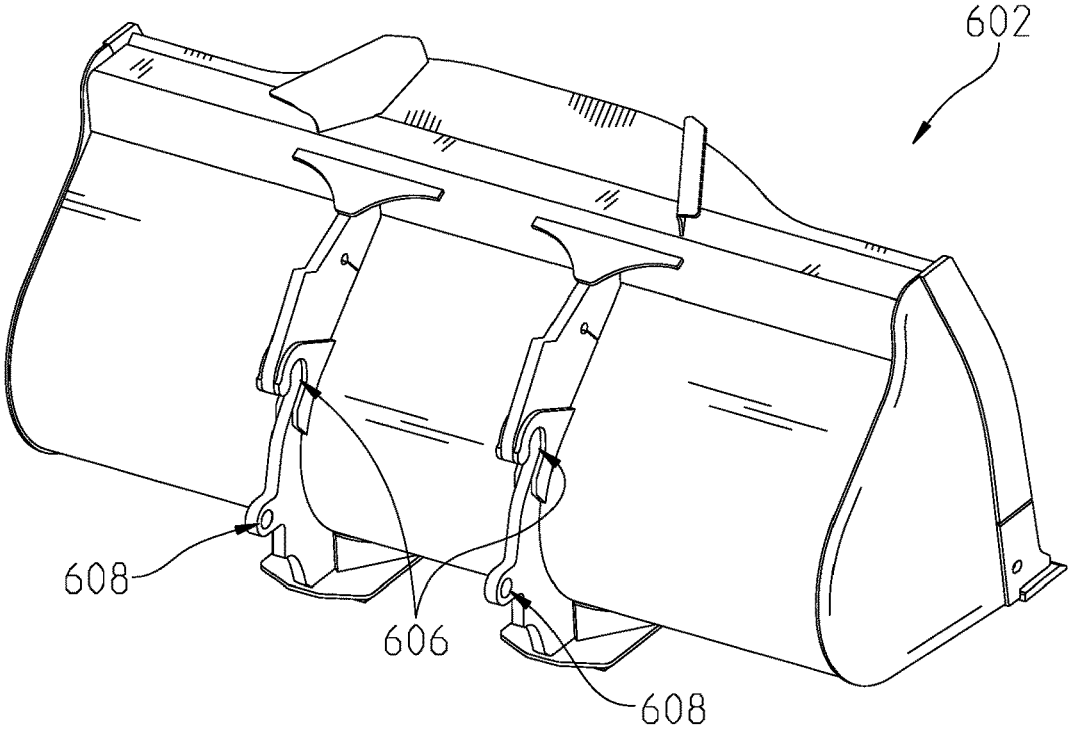
FIG. 6*b* is an elevated perspective view of the first device from FIG. 6*a;*

FIG. 5 illustrates a front view of the coupler 204 with the coupler engaging pin sets 428, 432 in a disengaged position. In one aspect of this disclosure, the first coupler hook pin set 426 may have a first coupler hook pin 502 defined between the inner plate 420 and the corresponding intermediate plate 422. The first coupler hook pin 502 may have a substantially circular cross-sections and be defined along a hook pin axis 504. The first coupler hook pins 502 may have a diameter and width sized to correspond with coupler hooks 606 (see FIG. 6*b*) of the first device 602.

Similarly, the first coupler engaging pin set 428 may have a first coupler engaging pin 506 that is selectively positionable between the inner plate 420 and the corresponding intermediate plate 422. The first coupler engaging pin 506 may be sized to correspond with first coupler through holes 608 (see FIG. 6*b*) of the first device 602. In one aspect of this disclosure, the first coupler engaging pin 506 may be defined along a first axis 508 and have a diameter that is slightly less than a diameter of the first coupler through hole 608. In this orientation, the first coupler engaging pin 506 may be selectively positioned through the corresponding first coupler through hole 608 to thereby lock the first device 602 to the coupler 204.

Figure 7:
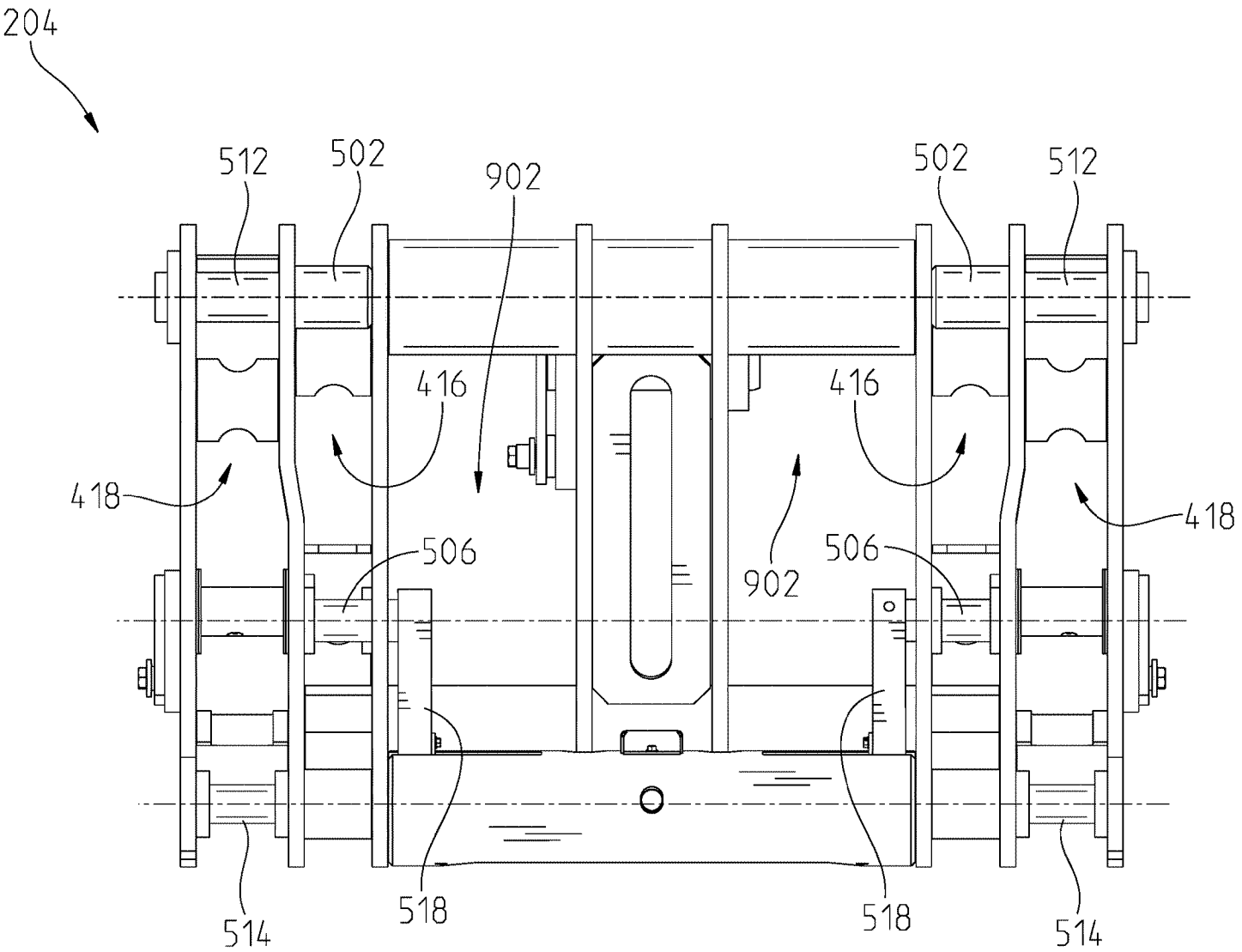
FIG. 7 is a front view of the dual interface coupler of FIG. 4 in an engaged position.

In one non-exclusive example of this disclosure, when the first coupler engaging pin set 428 is in the disengaged position illustrated in FIG. 5, the coupler hooks 606 of the first device 602 may be positioned around the corresponding first coupler hook pins 502. Then, the coupler 204 can be repositioned with the boom assembly 106 to align the first coupler through holes 608 with the corresponding first coupler engaging pins 506. Once the first device 602 is properly aligned with the coupler 204, a pin engagement cylinder 510 may move the first coupler engaging pins 506 to an engaged position (see FIG. 7) and the first device 602 may be coupled to the coupler 204.

Figure 6C:
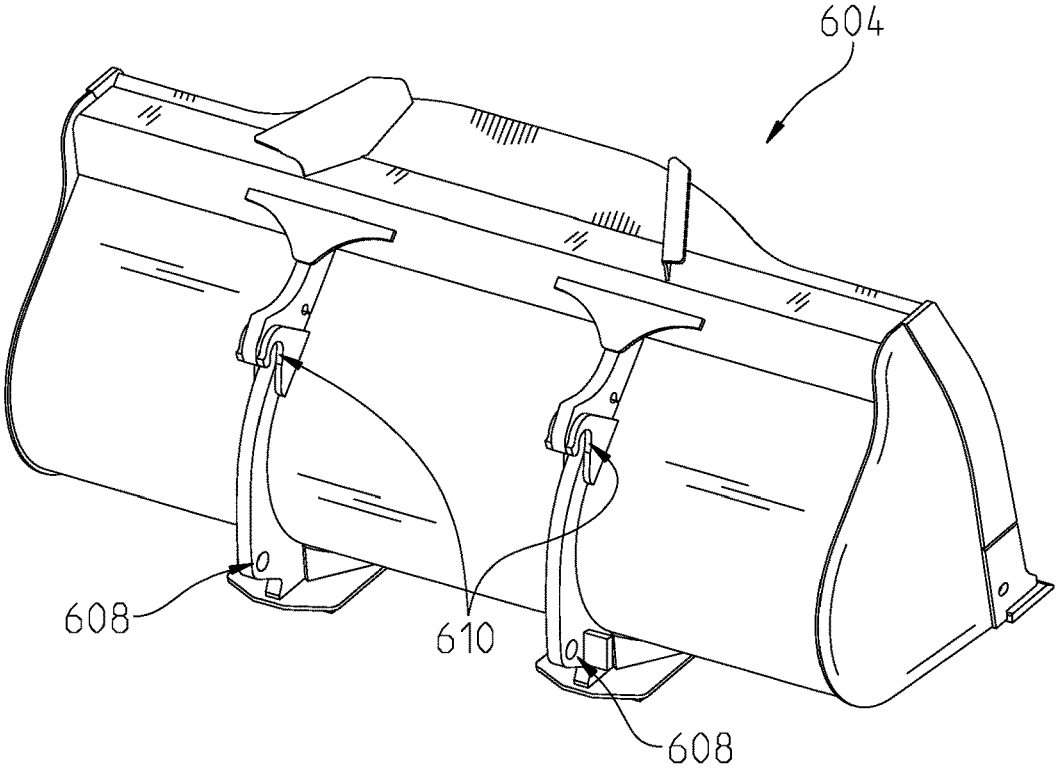
FIG. 6*c* is an elevated perspective view of the second device from FIG. 6*a;*

Similarly, the second coupler hook pin set 430 may have a second coupler hook pin 512 defined between each of the intermediate plates 422 and the corresponding end plates 424. The second coupler hook pin 512 may have substantially circular cross-section and be defined along the hook pin axis 504. The second coupler hook pin 512 may have a diameter and width sized to correspond with coupler hooks 610 (see FIG. 6*c*) of the second device 604.

The second coupler engaging pin set 432 may have second coupler engaging pins 514 that are selectively positionable between the intermediate plates 422 and corresponding end plates 424. The second coupler engaging pin 514 may be sized to correspond with second coupler through holes 608 (see FIG. 6*c*) of the second device 604. In one aspect of this disclosure, the second coupler engaging pin 514 may be defined along a second axis 516 and have a diameter that is slightly less than a diameter of the second coupler through holes 612. In this orientation, the second coupler engaging pin 514 may be selectively positioned through the corresponding second coupler through hole 612 to thereby lock the second device 604 to the coupler 204.

In one non-exclusive example of this disclosure, when the second coupler engaging pin set 432 is in the disengaged position illustrated in FIG. 5, the coupler hooks 610 of the second device 604 may be positioned around the corresponding second coupler hook pins 512. Then, the coupler 204 can be repositioned with the boom assembly 106 to align the second coupler through holes 612 with the corresponding second coupler engaging pins 514. Once the second device 604 is properly aligned with the coupler 204, the pin engagement cylinder 510 may move the second coupler engaging pins 514 to the engaged position and the second device 604 may be coupled to the coupler 204.

Each first coupler engaging pin 506 may be coupled to the corresponding second coupler engaging pin 514 with a pin engagement linkage 518. The pin engagement linkage 518 may substantially fixedly couple the adjacent coupler engaging pins 506, 514 to one another along their respective axes 508, 516. In this configuration, the pin engagement cylinder 510 may substantially simultaneously move the first coupler engaging pins 506 along the first axis 508 and the second coupler engaging pins 514 along the second axis 516. In other words, both the first and second coupler engaging pins 506, 514 are moved between the engaged and disengaged position substantially simultaneously.

In one aspect of this disclosure, the intermediate plate 422 may have a transverse bend 520 defined at a portion of the intermediate plate 422 between a first portion 522 and a second portion 524. The transverse bend 520 may be defined in the intermediate plate 422 to allow for a boom width 526 in the first portion 522 of the second coupler region 418 and a hook width 528 in the second portion 524 of the second coupler region 418. The boom width 526 may be greater than the hook width 528 and sized to be pivotally coupled to the coupler end 408 of the corresponding boom arm 402, 404. Similarly, the hook width 528 may be sized to correspond with the widths of the coupler hooks 610 of the second device 604. Accordingly, the transverse bend 520 allows the appropriate corresponding widths 526, 528 within the second coupler region 418.

In one aspect of this disclosure, the inner plates 420 and end plates 424 may be substantially planar and parallel to one another. In this configuration, the intermediate plate 422 may separate the first coupler region 416 from the second coupler region 418 and the transverse bend 520 may provide the transition from the boom width 526 to the hook width 528 as discussed herein.

Figure 8A:
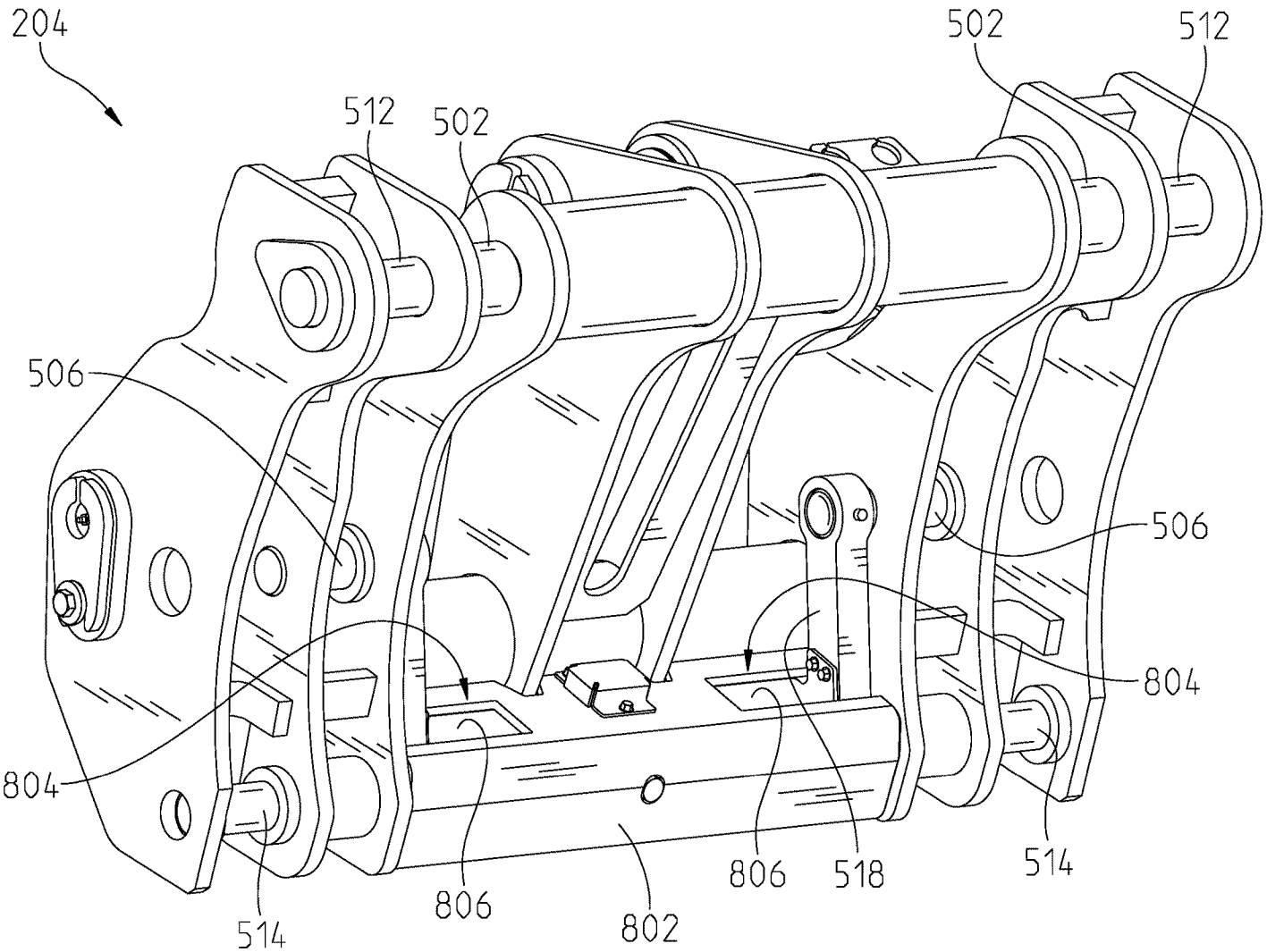
FIG. 8*a* is an elevated perspective view of the dual interface coupler of FIG. 4 in an engaged position.
Figure 8B:
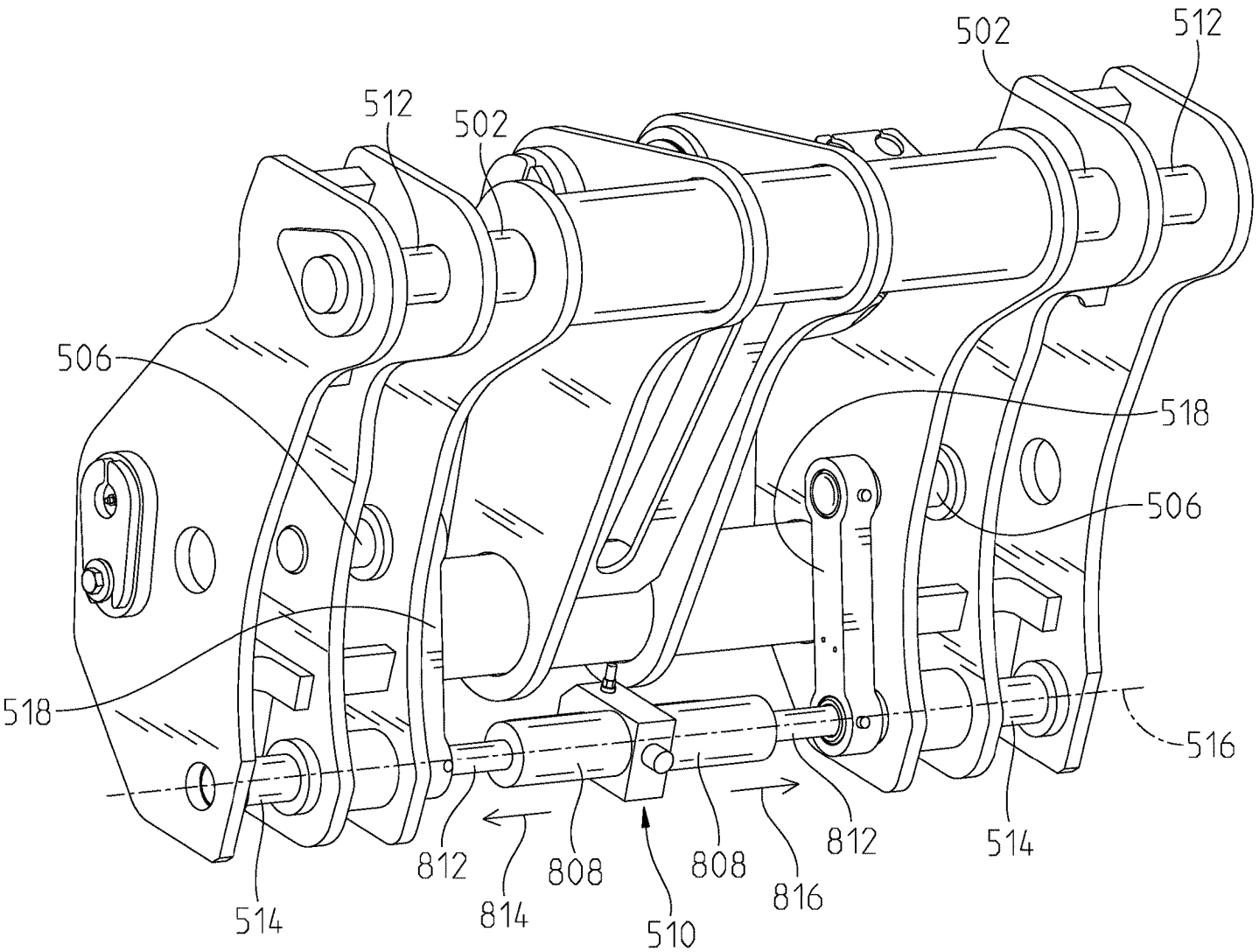
FIG. 8*b* is an elevated perspective view of the dual interface coupler of FIG. 8*a* with a front cover of a pin engagement cylinder removed.

Referring now to FIGS. 8*a* and 8*b*, the pin engagement cylinder 510 is illustrated in more detail. In FIG. 8*a*, a front cover 802 may be coupled to the coupler 204 to define an inner portion wherein the pin engagement cylinder 510 may be at least partially located. The coupler 204 is in the engaged position in FIG. 8*a* to illustrate a slot 804 defined in a portion of the front cover 802. The slot 804 may provide a clearance in the front cover 802 to allow the pin engagement linkage 518 to move between the engaged and disengaged positions.

In one aspect of this disclosure, a sliding cover 806 may be coupled to the pin engagement linkage 518 to move there with as the coupler engaging pins 506, 514 are moved between the engaged and disengaged position. The sliding cover 806 may be sized to correspond with the size of the slot 804 to substantially cover the slot 804 when the coupler engaging pins 506, 514 transition to the engaged position. More specifically, the sliding cover 806 may prevent debris and the like from entering the inner portion of the front cover 802 by covering the slot 804 while the coupler 204 is in the engaged position. Further, the sliding cover 806 may have a length sized to move along the slot 804 to allow the coupler engaging pins 506, 514 to move to the disengaged position without substantially contacting other components of the coupler 204.

FIG. 8*b* illustrates the coupler 204 in the engaged position with the front cover 802 and sliding covers 806 removed to more clearly illustrate the pin engagement cylinder 510. The pin engagement cylinder 510 may have a cylinder portion 808 and a first and second rod portion 810, 812 positioned at least partially within the cylinder portion 808. When fluid is supplied into the central portion of the cylinder portion 808 at a sufficient pressure, the first rod 812 may move in a first direction 816 while a second rod 814 is moving in a second direction 818. In one aspect of this disclosure, the first and second directions 816, 818 may be substantially opposite directions. In other words, each of the rods 812, 814 may have a piston coupled thereto and positioned within the cylinder portion 808. Accordingly, fluid pressure provided to the cylinder portion 808 may force the pistons in the cylinder portion away from one another, thereby moving the corresponding rods 812, 814 in their corresponding directions 814, 816.

In one aspect of this disclosure, the first and second rod 812, 814 may be defined along the second axis 516. In this configuration, the rods 812, 814 may be coupled to the second engaging pin 514 at the end of the rod distal to the cylinder portion 808. As the rods 812, 814 move axially along the second axis 516, the second engaging pin 514 also moves axially along the second axis 516. Further, the pin engagement linkage 518 may be coupled to either the rods 812, 814, or the second coupler engaging pin 514 to move the first coupler engaging pin 506 therewith. Accordingly, fluid pressure provided to the cylinder portion 808 may substantially simultaneously move the first and second rods 812, 814 along the second axis 516 in opposing directions. Further, rods 812, 814 may be coupled to at least one of the engaging pins 506, 514 or the pin engagement linkage 518 to move the coupler engaging pins 506, 514 and pin engagement linkage 518 axially along their respective axes 508, 516.

Figure 9:
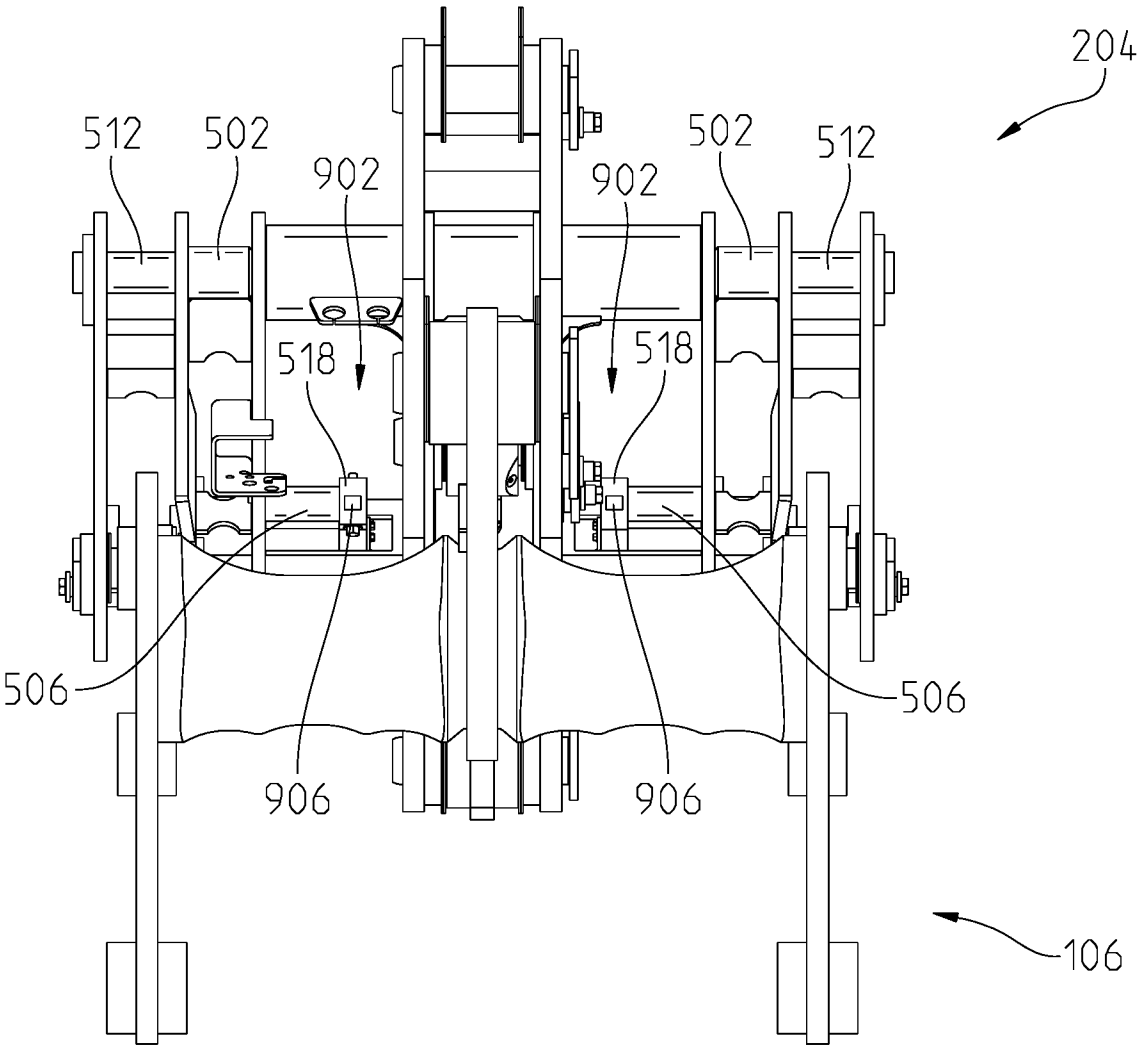
FIG. 9 is an elevated perspective view of a dual interface coupler coupled to a boom assembly as viewed from a cabin of a work machine.

Referring now to FIG. 9, an elevated perspective view of the coupler 204 coupled to the boom assembly 106 is illustrated from a perspective similar to a perspective from the cabin 110 of the work machine 100. From this perspective, visibility regions 902 through the coupler 204 are apparent. The visibility regions 902 may be the space between a center portion 904 of the coupler 204 and the corresponding inner plates 420. The visibility regions 902 may be an area substantially free of visual obstructions to allow a user in the cabin 110 to see through the visibility regions 902 of the coupler 204. The visibility regions 902 may assist the user in aligning the coupler 204 with the desired device to thereby couple the device to the coupler 204 among other things.

In one aspect of this disclosure, the first coupler engaging pins 506 may at least partially occupy the visibility regions 902 when in the disengaged position as illustrated in FIG. 9. Further, at least a portion of one or more of the first coupler engaging pins 506, the pin engagement linkage 518, and the slots 804 may have a visual indicator coupled thereto. The visual indicator 906 may be a high visibility paint, sticker, or other exterior coating that is easily visible by the user from the cabin 110. The visual indicator may be an easy and obvious indication to the user whether the coupler 204 is in the engaged position or the disengaged position. In other words, the visual indicators 906 may be a bright or otherwise obvious location for the user to check to ensure the coupler 204 is in the desired engagement position. Further, the visual indicators 906 may be on a portion of the coupler 204 that becomes at least partially positioned in the visibility region 902 when the coupler 204 is in the disengaged position.

Figure 10:
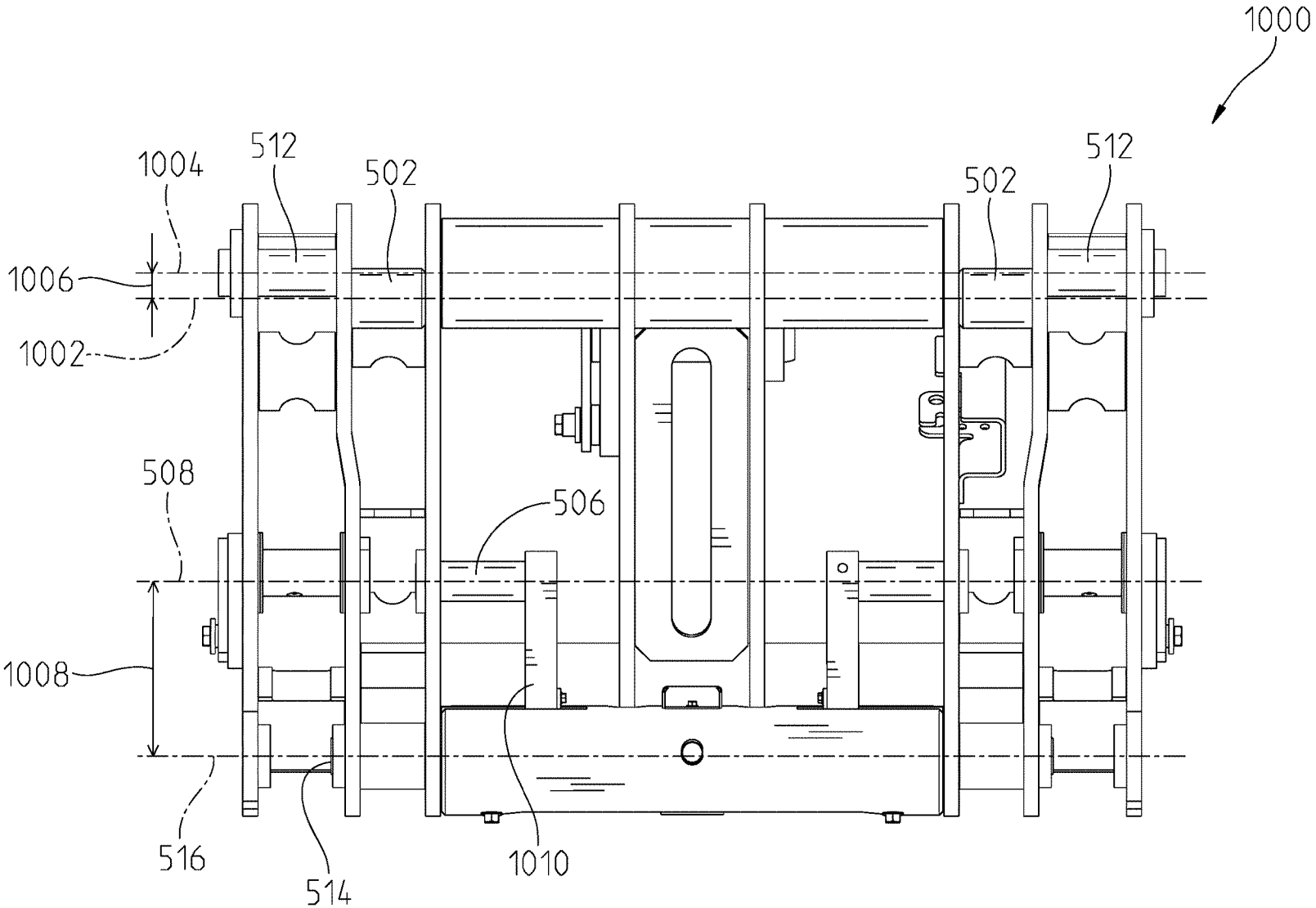
FIG. 10 is a front view of another embodiment of a dual interface coupler.

Referring now to FIG. 10, another embodiment of a dual interface coupler 1000 is illustrated. This embodiment may be substantially the same as the dual interface coupler 204 described herein. However, the first and second coupler hook pin 502, 512 may not be axially aligned. Rather, the first coupler hook pin 502 may be aligned along a first axis 1002 and the second coupler hook pin 512 may be aligned along a second axis 1004. The second axis 1004 may be spaced an axis offset 1006 from the first axis 1002. By moving the second coupler hook pin 502 the axis offset 1006 from the first coupler hook pin 502, the first and second coupler engaging pins 506, 514 may be aligned closer to one another compared to the dual interface coupler 204.

In one aspect of this disclosure, the dual interface coupler 1000 may have an engaging pin offset 1008 that is reduced compared to the dual interface coupler 204. In other words, by moving the second coupler hook pin 512 away from the first coupler hook pin 502, the second coupler engaging pin 514 may move closer to the first coupler engaging pin 506 while both pins 506, 514 still remain properly spaced to couple to the corresponding devices 602, 604. In one non-exclusive example of this configuration, a pin engagement linkage 1010 of FIG. 10 may be shorter than the pin engagement linkage 518 of FIG. 5.

In one aspect of the embodiment of FIG. 10, the second device 604 may be offset upward as viewed in FIG. 10 compared to the dual interface coupler 204 when the second device 604 is coupled to the dual interface coupler 1000. This upward offset may reduce the dual interface coupler's 1000 clearance relative to the ground when in a lowered position. This reduced clearance may provide additional handling characteristics of the second device 604.

In one application of this disclosure, a user may enter the cabin 110 of the work machine 100 and interact with user controls to manipulate the orientation of the boom assembly 106 and the dual interface coupler 204 coupled thereto. The user controls may allow the user to transition the coupler 204 between the engaged position and the disengaged position by interacting with the pin engagement cylinder 510 to reposition the corresponding coupler engaging pins 506, 514. The user may also utilize the user controls to move the work machine along the underlying surface 114 with the ground engaging mechanism 112. Accordingly, the user may utilize the user controls to position the work machine 100 and coupler 204 as desired.

In this non-exclusive example, the user may approach either the first or second device 602, 604 and align the coupler 204 therewith. The user may utilize the visibility region 902 to align the coupler with the device and further inspect the visual indicator 906 to ensure that the coupler 204 is in the disengaged position. The user may then manipulate the position of the coupler 204 by moving the work machine 100 with the ground engaging mechanisms 112 and by moving the boom assembly 106 to align the coupler hooks 606 or 610 with the corresponding first or second coupler hook pins 502 or 512.

Once the coupler hooks 606 or 610 have hooked onto the corresponding coupler hook pins 502 or 512, the user may manipulate the coupler 204 to align the corresponding coupler through holes 608 or 612 with the corresponding first or second axis 508, 516 of the coupler 204. Once aligned, the user may transition the coupler 204 from the disengaged position to the engaged position by engaging the pin engagement cylinder 510 to move the coupler engaging pins 506, 514 axially along the corresponding axes 508, 516. As discussed herein, the pin engagement linkage 518 ensures that both coupler engaging pins 506, 514 are moved at substantially the same time. Further, the user may visually confirm that the coupler 204 is in the engaged position by viewing the visual indicator 906 through the visibility region 902.

Alternatively, the user may transition the coupler 204 to the disengaged position and remove any device coupled thereto utilizing substantially similar, but opposite, steps as those described for coupling a device thereto. As is apparent from this disclosure, the user may easily switch between the first device 602 which is coupled to the first coupler region 416 of the coupler 204 and the second device 604 which is coupled to the second coupler region 418 without leaving the cabin 110.

While exemplary embodiments incorporating the principles of the present disclosure have been described herein, the present disclosure is not limited to such embodiments. Instead, this application is intended to cover any variations, uses, or adaptations of the disclosure using its general principles. Further, this application is intended to cover such departures from the present disclosure as come within known or customary practice in the art to which this disclosure pertains.

The invention claimed is:

1. A coupler for a work machine, comprising:

a first coupler hook pin defined coaxially along a hook pin axis;

a second coupler hook pin defined coaxially along the hook pin axis and axially offset along the hook pin axis relative to the first coupler hook pin;

a first coupler engaging pin defined along a first axis;

a second coupler engaging pin defined along a second axis, the second axis being different from the first axis; and a pin engagement cylinder positioned along the second axis that selectively transitions the first coupler engaging pin and the second coupler engaging pin between an engaged position and a disengaged position;

wherein, the first coupler engaging pin is coupleable to a first device and the second coupler engaging pin is coupleable to a second device.

2. The coupler of claim 1, further wherein the first device is coupleable to the coupler at the first coupler hook pin and the first coupler engaging pin and the second device is coupleable to the coupler at the second coupler hook pin and the second coupler engaging pin.

3. The coupler of 1, further wherein the pin engagement cylinder is spaced from the first axis at least partially away from the hook pin axis to partially define a visibility region through the coupler.

4. The coupler of claim 3, further wherein the first axis is defined through the visibility region but the first coupler engaging pin does not substantially block the visibility region.

5. The coupler of claim 1, further comprising a pin engagement linkage coupling the first coupler engaging pin to the second coupler engaging pin.

6. The coupler of claim 5, further wherein the pin engagement linkage has a visual indicator formed of at least one of a high visibility paint or a sticker.

7. The coupler of claim 5, further wherein the pin engagement cylinder is coupled to the second coupler engaging pin to selectively slide the first and second coupler engaging pins between an engaged positioned and a disengaged position; and the coupler comprises a front cover defining an inner cavity and having a slot defined therethrough, wherein the pin engagement cylinder is positioned substantially within the inner cavity of the front cover to prevent debris from contacting the pin engagement cylinder.

8. The coupler of claim 7, further comprising a sliding cover positioned along the slot and configured to slide along the slot as the first and second coupler engaging pins move between the engaged and disengaged position, wherein when the first and second coupler engaging pins are in the engaged position, the sliding cover substantially covers the slot.

9. A dual interface coupler for a work machine, comprising:

a first coupler hook pin defined along a hook pin axis;

a first coupler engaging pin defined along a first axis;

a second coupler engaging pin defined along a second axis, the second axis being different from the first axis;

a pin engagement linkage coupling the first coupler engaging pin to the second coupler engaging pin; and a pin engagement cylinder coupled to the pin engagement linkage and positioned within an inner cavity of a cover;

wherein, the cover comprises a slot for the pin engagement linkage to extend from the inner cavity to the first coupler engaging pin and the cover substantially prevents debris from contacting the pin engagement cylinder.

10. The dual interface coupler of claim 9, wherein, the first engaging pin is slidable axially along the first axis and the second engaging pin is slidable axially along the second axis and the pin engagement linkage couples the first coupler engaging pin to the second coupler engaging pin such that axial movement of one of the first or second coupler engaging pin causes axial movement of the other of the first or second coupler engaging pin.

11. The dual interface coupler of claim 9, further comprising a second coupler hook pin axially offset along the hook pin axis relative to the first coupler hook pin, wherein a first device is coupleable to the coupler at the first coupler hook pin and the first coupler engaging pin along a first coupler region and a second device is coupleable to the coupler at the second coupler hook pin and the second coupler engaging pin along a second coupler region.

12. The dual interface coupler of claim 11, further wherein the first coupler region and the second coupler region are separated from one another by an intermediate plate, the intermediate plate having a transverse bend between the first coupler engagement pin and the first coupler hook pin.

13. The dual interface coupler of claim 12, further wherein the second coupler region has a boom width at a first portion and a hook width at a second portion, the transverse bend of the intermediate plate defining the transition from the boom width to the hook width.

14. A work machine, comprising:

a ground engaging mechanism comprising at least one of a wheel or a track assembly, the ground engaging mechanism coupled to a chassis to selectively move the work machine along an underlying surface;

a boom assembly pivotally coupled to the chassis; and a dual interface coupler coupled to the boom assembly, the dual interface coupler comprising:

a first coupler hook pin set defined coaxially along a hook pin axis;

a second coupler hook pin set defined coaxially along the hook pin axis;

a first coupler engaging pin set defined along a first axis;

a second coupler engaging pin set defined along a second axis, the second axis being different from the first axis; and a pin engagement cylinder that selectively transitions the first coupler engaging pin set and the second coupler engaging pin set between an engaged position and a disengaged position; and a front cover having an inner portion that at least partially covers the pin engagement cylinder, the front cover providing slots for a linkage set to extend from the inner portion to the first engaging pin set;

wherein, the first coupler hook set and the first coupler engaging pin set are coupleable to a first device and the second coupler hook pin set and the second coupler engaging pin set are coupleable to a second device.

15. The work machine of claim 14, further wherein the pin engagement cylinder comprises a single housing and two pistons acting in opposite directions of one another.

16. The work machine of claim 15, further wherein the linkage set couples the first coupler engaging pin set and the second coupler engaging pin set to one another, the linkage set having an indicator thereon formed of at least one of a high visibility paint or a sticker.

* * * * *